US006508432B2

(12) United States Patent
Krivulin

(10) Patent No.: US 6,508,432 B2
(45) Date of Patent: Jan. 21, 2003

(54) DUAL TOILET ROLL DISPENSER

(75) Inventor: Semion Krivulin, Richmond (CA)

(73) Assignee: Englewood Ventures, Inc. (CA)

( * ) Notice: Subject to any disclaimer, the term of this patent is extended or adjusted under 35 U.S.C. 154(b) by 0 days.

(21) Appl. No.: 09/809,005

(22) Filed: Mar. 16, 2001

(65) Prior Publication Data

US 2002/0130215 A1 Sep. 19, 2002

(51) Int. Cl.[7] ..... B65H 19/00

(52) U.S. Cl. ..... 242/560.3; 242/560.2; 242/558; 242/559; 242/559.3; 242/560

(58) Field of Search ..... 242/560.3, 560.2, 242/560, 559, 559.4, 559.3

(56) References Cited

U.S. PATENT DOCUMENTS

| | | | | |
|---|---|---|---|---|
| 3,698,653 A | * | 10/1972 | Okamura | 242/55.3 |
| 3,754,719 A | * | 8/1973 | Choy | 242/55.3 |
| 3,948,454 A | | 4/1976 | Bastian | |
| 4,383,657 A | | 5/1983 | Suh | |
| 4,422,585 A | | 12/1983 | Schultz et al. | |
| 5,265,816 A | | 11/1993 | Collins | |
| 5,628,474 A | | 5/1997 | Krueger et al. | |
| 5,645,244 A | | 7/1997 | Moody | |
| 5,690,299 A | | 11/1997 | Perrin et al. | |
| 5,868,335 A | * | 2/1999 | Lebrun | 242/560.3 |
| 5,873,542 A | | 2/1999 | Perrin et al. | |

FOREIGN PATENT DOCUMENTS

GB 1339084 11/1973

* cited by examiner

*Primary Examiner*—Donald P. Walsh
*Assistant Examiner*—Jonathan R. Miller
(74) *Attorney, Agent, or Firm*—Hall, Priddy, Myers & Vande Sande

(57) ABSTRACT

The invention is a toilet paper dispenser designed to hold two rolls of toilet paper. The dispenser has a housing containing a primary roll support and a secondary roll support. The secondary roll support is disposed parallel to and vertically above the primary roll support. The secondary roll support is connected to a release mechanism operative to lower the secondary roll support into a position to dispense toilet paper from its roll of toilet paper when the primary roll of toilet paper is exhausted. A roll guard prevents access to the secondary roll until the release mechanism has been activated. The release mechanism is automatically activated and released by a user-controlled trigger mechanism, preferably a lever, so that a user exhausting the primary roll of toilet paper may access the secondary roll without interfering with the dispenser.

11 Claims, 5 Drawing Sheets

DUAL TOILET ROLL DISPENSER

FIELD

The invention relates to toilet roll dispensers capable of holding a spare roll of toilet paper for dispensing after a primary roll of toilet paper has been exhausted.

BACKGROUND

A common concern in providing toilet paper for use in public facilities is the provision of extra rolls of toilet paper in dispensers. The provision of extra rolls in a toilet paper dispenser allows for less time to be spent on maintenance to ensure that the dispensers have an adequate supply of toilet paper. However, there must also be a means provided to ensure that the extra rolls are not accessible until needed, to prevent waste and theft. An additional concern is keeping the size of the dispenser to a minimum, both to optimize the use of space within the bathroom stall and to enhance aesthetics.

Prior art dispensers have attempted to address these problems. U.S. Pat. No. 5,265,816, issued Nov. 30, 1993 to Collins, discloses a double roll tissue dispenser that has the rolls mounted side-by-side on fixed roll supports. A slider located beneath the roll supports allows access to only one roll at any given time. The slider has extended pivoting spring-loaded arms that surround the roll not being dispensed. The arms are sized to prevent the slider from moving until the roll being dispensed is exhausted. However, the pivoting arms and supporting springs in the Collins dispenser are subject to breakage from users who mishandle the slider through carelessness or excessive force. Also, the side-by-side orientation of the rolls results in a lateral change in dispensing position when the slider is repositioned to access a new roll. This lateral position change can make accessing the new roll difficult for some users.

U.S. Pat. No. 5,645,244, issued Jul. 8, 1997 to Moody, discloses a single or double roll dispenser where the roll supports are mounted on pivoting arms such that the roll being dispensed maintains continual contact with the roll support surface. The roll support surface is slidable to allow dispensing of only one roll at a time. However, the Moody dispenser does not disclose any means of preventing the user from accessing the second roll until the first roll has been exhausted. Also, the side-by-side configuration results in roll positioning problems as discussed previously.

U.S. Pat. No. 5,873,542, issued Feb. 23, 1999 to Perrin et al., discloses a double roll dispenser using a dual mandrel with roll supports mounted on the opposite extreme ends of the mandrel. The mandrel rests in a parallel pair of guide slots formed by the dispenser housing and wall base. The guide slots are shaped such that the mandrel cannot be moved into the lower guide slot position to dispense the second roll until the first roll is almost exhausted. The user manually moves the mandrel by reaching into the dispenser and repositioning the mandrel in the guide slots. The need for the user to manually adjust the mandrel can result in the dispenser being jammed or broken through mishandling of the mandrel by the user. Also, the Perrin et al. dispenser does not provide any means of preventing access to the second roll while the first roll is being dispensed, which can lead to waste or depletion of the second roll while the first roll is only partially exhausted.

Based on the deficiencies in the above prior art, the object of the invention is to provide a dual roll toilet paper dispenser that holds a secondary roll in an inaccessible position until the primary roll is exhausted. The invention also provides a user-activated trigger mechanism to automatically bring the secondary roll into position without any user intervention with the dispenser mechanism.

A further object of the invention is to provide a restrictor such that the trigger mechanism cannot be activated until the primary roll has been exhausted.

SUMMARY

The invention is a toilet paper dispenser designed to hold two rolls of toilet paper. The dispenser has a housing containing two roll supports, a primary roll support and a secondary roll support. The secondary roll support is disposed parallel to and vertically above the primary roll support. The secondary roll support is connected to a release mechanism operative to lower the secondary roll support into a position to dispense toilet paper from the secondary roll of toilet paper when the primary roll of toilet paper is exhausted. A roll guard prevents access to the secondary roll until the release mechanism has been activated. The release mechanism is activated by a user-controlled trigger mechanism, preferably a lever, so that a user exhausting the primary roll of toilet paper may access the secondary roll without interfering with the operation of the dispenser.

Preferably, the release mechanism is designed such that the roll supports cannot be moved until the primary roll of toilet paper on the primary roll support is exhausted.

BRIEF DESCRIPTION OF THE DRAWINGS

The invention itself both as to organization and method of operation, as well as additional objects and advantages thereof, will become readily apparent from the following detailed description when read in connection with the accompanying drawings.

DETAILED DESCRIPTION

Figure 1:
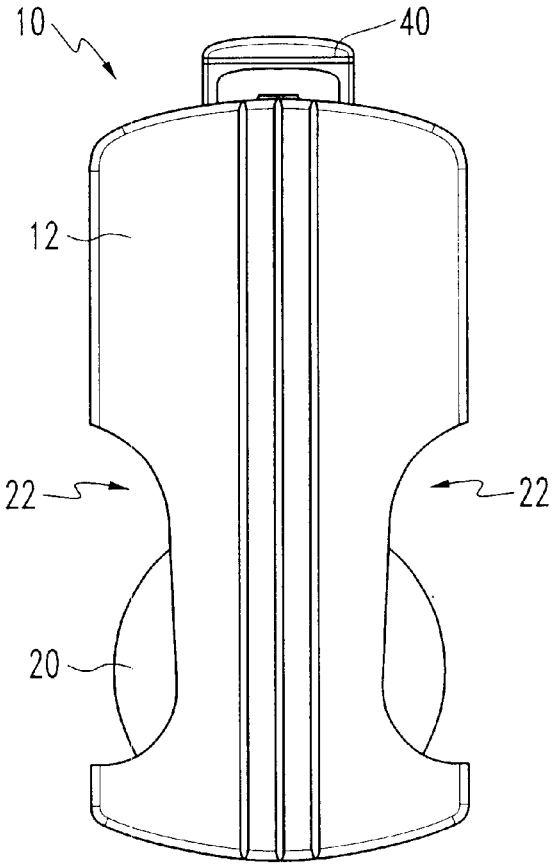
FIG. 1 is a front view of the dispenser.

The invention comprises a toilet paper dispenser 10 as shown in FIG. 1 with the primary roll of toilet paper 20 and the secondary roll of toilet paper 30 (see FIG. 5) at full capacity. The primary roll of toilet paper 20 is easily accessible through the opening 22 to allow a user to dispense toilet paper from the primary roll of toilet paper 20. The secondary roll of toilet paper 30 is not accessible (see FIG. 5). A user activates lever 40 located at the top of dispenser 10 to move secondary roll 30 into position for dispensing once primary roll 20 has been exhausted. The lever 40 cannot be successfully activated unless the primary roll 20 has been exhausted. The overall dimensions of the dispenser 10 are determined by the size of the toilet paper rolls being dispensed.

Figure 2:
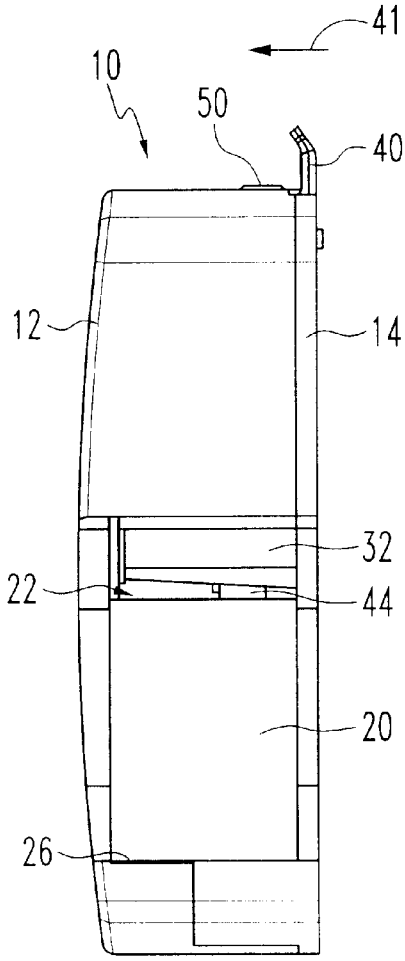
FIG. 2 is a side view of the dispenser.
Figure 3:
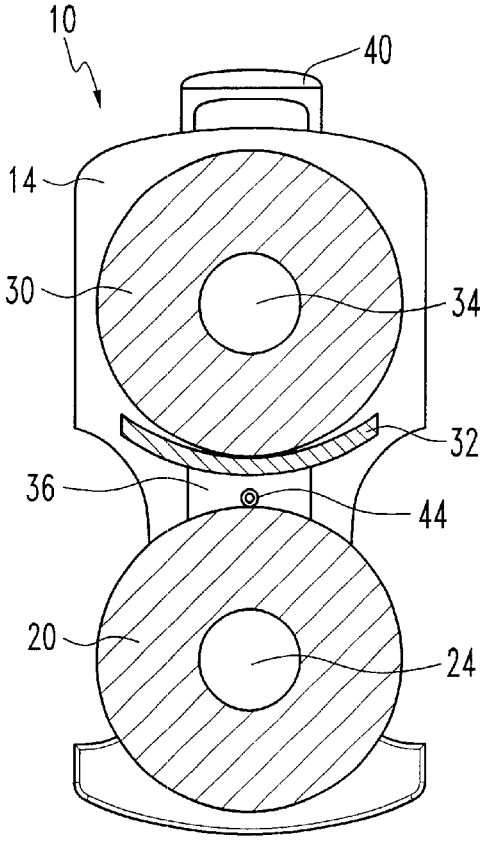
FIG. 3 is a front view of the open dispenser.

FIG. 2 shows a side view of the dispenser 10. The lower cutting edge 26 and the base of the secondary roll guard 32 can be seen through the opening 22. The roller guide bar 44 rests on top of the full primary roll 20. The dispenser 10 is comprised of a front housing 12 and a rear housing 14 which are pivotally engaged at the base of the dispenser 10 and secured by a lock mechanism 50 at the top of the dispenser 10. Front housing 12 can be pivoted away from rear housing 14 to allow replacement of exhausted rolls as discussed below. FIG. 3 shows the front of an open dispenser 10 with both rolls 20 and 30 at full capacity.

Figure 4:
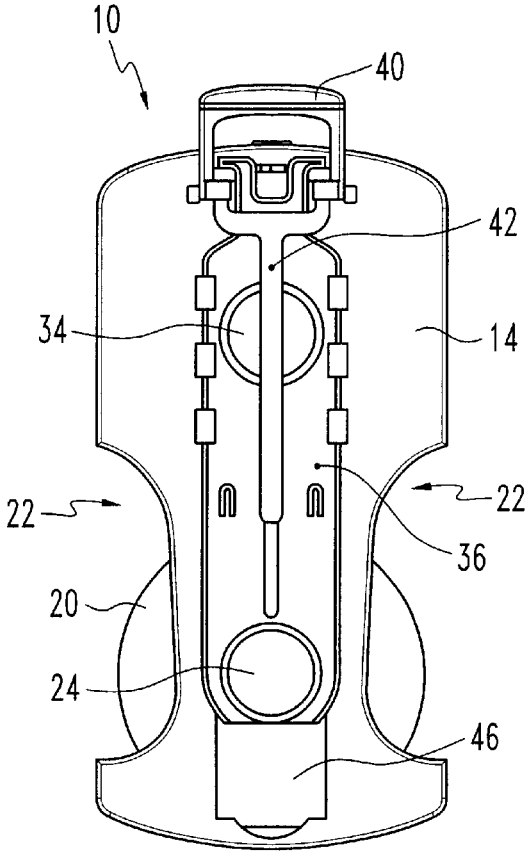
FIG. 4 is a rear view of the dispenser.

FIG. 4 shows a rear view of the dispenser 10. The primary roll support 24 is attached to the bottom of a sliding mandrel 36. The secondary roll support 34 is attached to the top of sliding mandrel 36 and sliding mandrel 36 is held in place by lever 40 and a holding mechanism 42. The roller guide bar 44 is attached to holding mechanism 42 (see FIG. 10A) to control the position of holding mechanism 42. The holding mechanism 42 acts as a physical impediment to lever 40. The roll supports 24 and 34, the roll guard 32 and the roller guide bar 44 pass through a channel 46 (shown more fully in FIG. 11) in the rear housing 14 to allow movement of sliding mandrel 36 and holding mechanism 42. As primary roll 20 is consumed, guide bar 44 moves down in channel 48 (shown in FIG. 9), moving holding mechanism 42. Once the guide bar 44 has moved to the end of channel 48, touching primary roll support 24, holding mechanism 42 is clear to allow lever 40 to be activated. When lever 40 is activated by the user, the roll support 34 is released and is lowered into position for dispensing the secondary roll 30 as shown in FIGS. 5 to 8. Lever 40 acts as a trigger for releasing sliding mandrel 36 and allowing it to move downwardly and may be replaced by any simple triggering mechanism, such as a push button.

Figure 9:
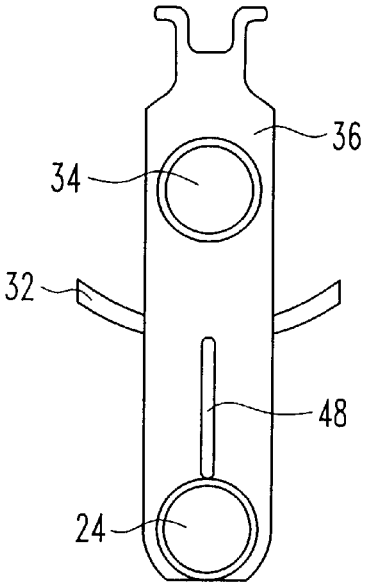
FIG. 9 is a rear view of the sliding mandrel.
Figure 10:
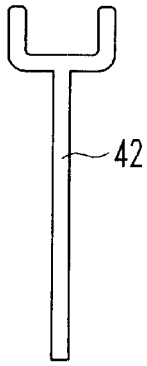
FIG. 10 is a rear view of the holding mechanism.
Figure 10A:
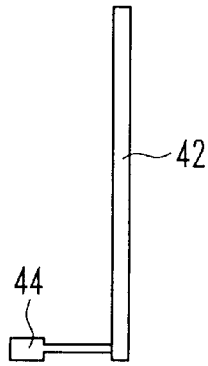
FIG. 10A is a side view of the holding mechanism.
Figure 11:
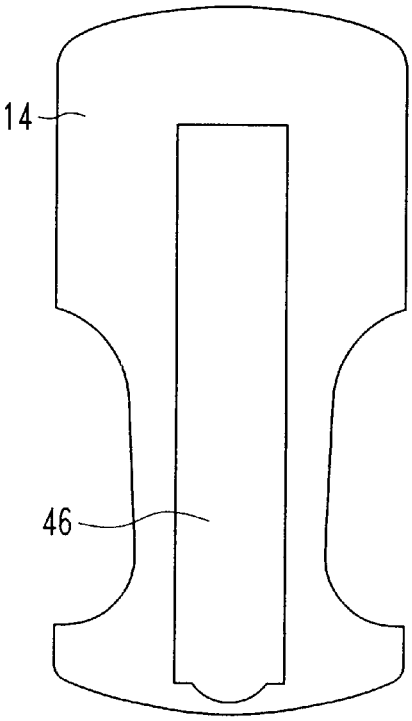
FIG. 11 is a rear view of the rear housing.

FIGS. 9, 10, 10A and 11 show the individual elements of the overall mechanism. FIG. 9 shows the sliding mandrel 36, which includes a channel 48 through which the roller guide bar 44 is inserted. FIGS. 10 and 10A show the holding mechanism 42 and the location of the roller guide bar 44. FIG. 11 shows the rear housing 14 and the channel 46 through which the roll supports 24 and 34 and the secondary roll guard 42 are inserted.

Figure 12:
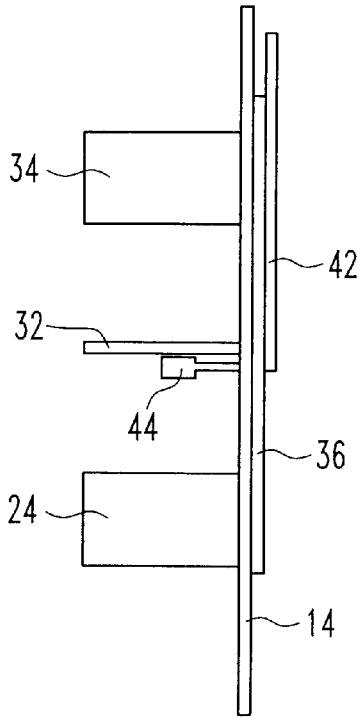
FIG. 12 is a section view of the rear housing in combination with the sliding mandrel and holding mechanism.

FIG. 12 shows how the holding mechanism 42, the sliding mandrel 36 and the rear housing 14 are fitted together through channels 46 and 48 (as shown in FIGS. 11 and 9, respectively) to form a completed product.

Figure 5:
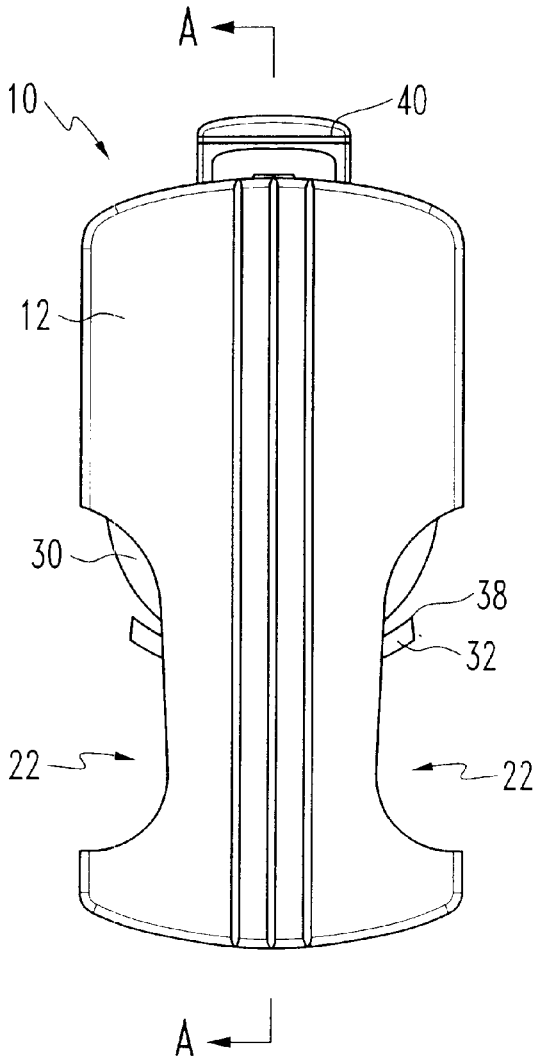
FIG. 5 is a front view of the dispenser, with the secondary roll support lowered into dispensing position.

FIG. 5 shows a front view of the dispenser 10 after the primary roll 20 (see FIG. 1) has been exhausted and the secondary roll 30 has been lowered into place. The secondary roll guard 32 is visible through the opening 22 and provides support for the secondary roll 30 as well as a cutting edge 38 for use when dispensing the secondary roll 30 through the opening 22.

Figure 6:
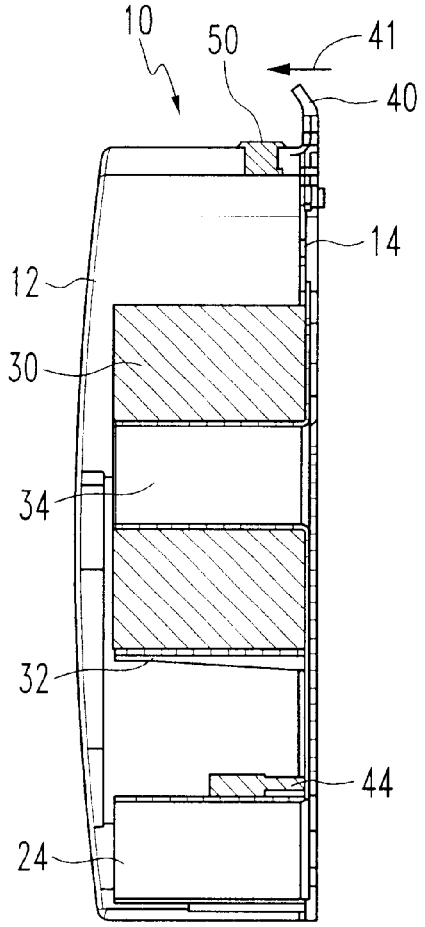
FIG. 6 is a section view of the dispenser along axis A—A of FIG. 5, with the secondary roll support lowered into dispensing position.

FIG. 6 shows a section view of the dispenser 10 along the axis A—A of FIG. 5. The secondary roll support 34 has been lowered into a dispensing position. The primary roll support 24 has been lowered to the bottom of channel 46 (as shown in FIG. 11) at the base of the dispenser 10, stopping the downward movement of sliding mandrel 36 in the position shown in FIGS. 5–8.

Figure 7:
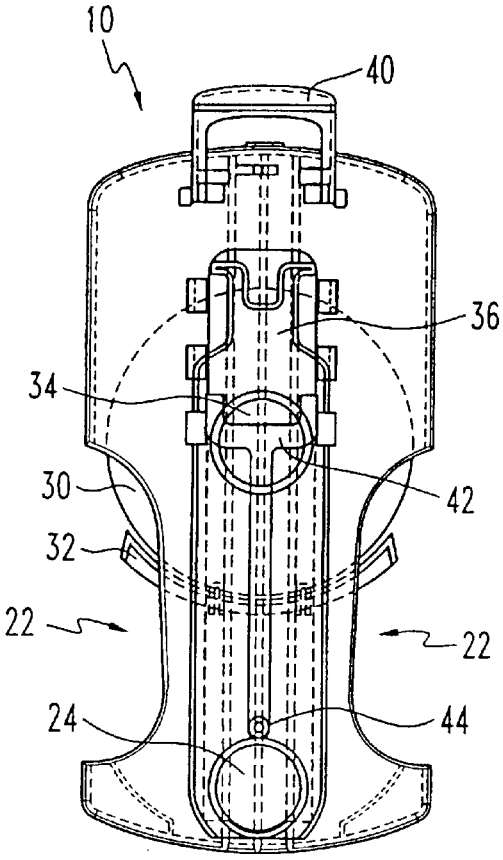
FIG. 7 is a transparent rear view of the dispenser, with the secondary roll support lowered into dispensing position.

FIG. 7 shows a transparent rear view of the dispenser 10 with the secondary roll 30 lowered into a dispensing position. The holding mechanism 42 has been released to lower the sliding mandrel 36 and the attached secondary roll support 34 and primary roll support 24. The roller guide bar 44 now rests on top of the primary roll support 24.

Figure 8:
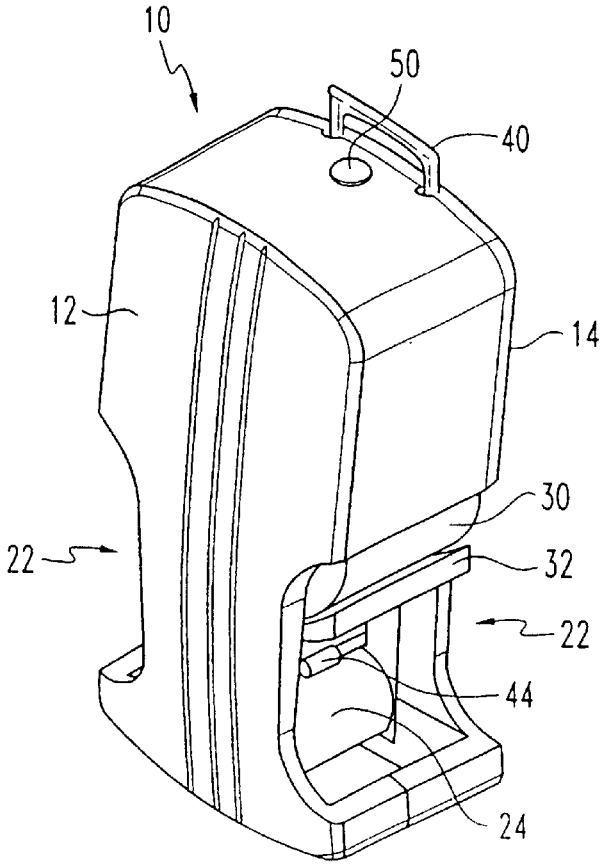
FIG. 8 is a perspective view of the dispenser, with the secondary roll support lowered into dispensing position.

FIG. 8 shows a perspective view of the dispenser 10 with the secondary roll 30 lowered into dispensing position. The primary roll support 24 is exposed at the base of the dispenser 10 through the opening 22.

During operation of the dispenser 10 as shown in FIG. 1, toilet paper is dispensed to the user from the primary roll 20 through the opening 22. When the primary roll 20 is exhausted, the user activates the lever 40 to move the secondary roll 30 into position for dispensing. The roller guide bar 44 controls the movement of holding mechanism 42, which prevents the activation of lever 40 and therefore the movement of sliding mandrel 36. As the primary roll 20 is consumed, the guide bar 44 and holding mechanism 42 will move further along channel 48. When the primary roll 20 is fully exhausted, then holding mechanism 42 will have moved far enough to allow lever 40 to be activated resulting in sliding mandrel 36 lowering into position for dispensing the secondary roll 30. The operation of the dispenser 10 then continues as shown in FIG. 5. By preventing the user from accessing the secondary roll 30 until the primary roll 20 is exhausted, the potential waste or theft of rolls is reduced.

To replace exhausted rolls, the maintenance attendant unlocks the lock 50, allowing the front housing 12 to be pivoted away from the rear housing 14 to expose the roll supports as shown in FIG. 3. Fresh rolls of toilet paper can then be exchanged with exhausted ones. The front housing 12 is pivotally engaged to the rear housing 14 at the base of the dispenser 10 for support of the front housing 12 while the dispenser 10 is open. Alternatively, the front housing 12 may be removably attached to the rear housing 14 by a tab-and-slot or similar connection to simplify construction.

The lock 50 secures front housing 12 to rear housing 14 and prevents users from tampering with the operation of the dispenser 10 or removing the secondary roll 30 by opening the front housing 12.

While the dispenser 10 is open, the maintenance attendant also manually resets the sliding mandrel 36 for future use by moving the sliding mandrel 36 back into the starting position shown in FIG. 4, where sliding mandrel 36 locks into place with holding mechanism 42 and lever 40.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the scope of the invention.

I claim:

1. A toilet paper dispenser, comprising:

a) a housing having an opening for dispensing toilet paper;

b) a primary roll support positioned within said housing to support a primary roll of toilet paper mounted on said primary roll support such that said primary roll of toilet paper is accessible through the opening in said housing;

c) a secondary roll support positioned within said housing parallel to and vertically above said primary roll support when said dispenser is mounted for operation and said secondary roll support being operative to support a secondary roll of toilet paper;

d) a release mechanism operative to lower said secondary roll support to allow access to said secondary roll of toilet paper through the opening and operative such that said secondary roll support is positioned parallel to and vertically above said primary roll support after activation of said release mechanism; and e) a roll guard operative to prevent access to said secondary roll of toilet paper until said release mechanism is activated.

2. The toilet paper dispenser according to claim 1, wherein said release mechanism comprises a slidable mandrel connected to said primary roll support, said secondary roll support, said roll guard and said roller guide bar.

3. The toilet paper dispenser according to claim 2, wherein said release mechanism further includes a restrictor connected to said slidable mandrel operative to prevent activation of said release mechanism until said primary roll of toilet paper is exhausted.

4. The toilet paper dispenser according to claim 3, wherein said restrictor comprises a roller guide bar which rests on an upper surface of said primary roll of toilet paper when said primary roll of toilet paper is at full capacity and rests on an upper surface of said primary roll support when said primary roll of toilet paper is exhausted and wherein said roller guide bar is operative to prevent said release mechanism from being activated until said roller guide bar rests on said primary roll support.

5. The toilet paper dispenser according to claim 1, including a user-controlled trigger mechanism operative to activate said release mechanism.

6. The toilet paper dispenser according to claim 5, wherein said user-controlled trigger mechanism is a lever.

7. The toilet paper dispenser according to claim 1, wherein said primary roll support is lowered by said release mechanism together with said secondary roll support.

8. A toilet paper dispenser, comprising:

a) a housing having an opening for dispensing toilet paper;

b) a primary roll support positioned within said housing to support a primary roll of toilet paper mounted on said primary roll support such that said primary roll of toilet paper is accessible through the opening in said housing;

c) a secondary roll support positioned within said housing parallel to and vertically above said primary roll support when said dispenser is mounted for operation and said secondary roll support is operative to support a secondary roll of toilet paper;

d) a release mechanism operative to lower said secondary roll support to allow access to said secondary roll of toilet paper through the opening and operative such that said secondary roll support is positioned parallel to and vertically above said primary roll support after activation of said release mechanism;

e) a roll guard operative to prevent access to said secondary roll of toilet paper until said release mechanism is activated; and f) a user-controlled trigger mechanism operative to activate said release mechanism, wherein said release mechanism includes a restrictor operative to prevent activation of said release mechanism until said primary roll of toilet paper is exhausted.

9. The toilet paper dispenser according to claim 8, wherein said restrictor comprises a roller guide bar such that said guide bar rests on an upper surface of said primary roll of toilet paper when said primary roll of toilet paper is at full capacity and rests on an upper surface of said primary roll support when said primary roll of toilet paper is exhausted and wherein said roller guide bar is operative to prevent said release mechanism from being activated until said roller guide bar rests on said primary roll support.

10. The toilet paper dispenser according to claim 8, wherein said user-controlled is a lever.

11. A toilet paper dispenser, comprising:

a) a housing having an opening through which toilet paper is dispensed;

b) a primary roll support for supporting a primary roll of toilet paper, said primary roll support being positioned within said housing so that said primary roll of toilet paper is accessible through the opening;

c) a thickness sensor coupled to said primary roll of toilet paper and operative to sense a thickness thereof;

d) a secondary roll support for supporting a secondary roll of toilet paper, said secondary roll support being positioned above said primary roll support when said toilet paper dispenser is mounted for operation;

d) a release mechanism coupled to said primary roll support and to said secondary roll support and operative, when activated by a sensor coupled to said primary roll support, to lower said primary and said secondary roll support so that said secondary roll of toilet paper is accessible through the opening; and e) a roll guard operative to prevent access to said secondary roll of toilet paper until said release mechanism is activated.

* * * * *